US006216775B1

(12) United States Patent
Hedman

(10) Patent No.: US 6,216,775 B1
(45) **Date of Patent: *Apr. 17, 2001**

(54) ARRANGEMENT FOR FLOW REDUCTION IN PLATE OIL COOLER

(75) Inventor: Rolf Hedman, Linköping (SE)

(73) Assignee: Valeo Engine Cooling AB, Linkoping (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,924

(22) PCT Filed: Nov. 10, 1997

(86) PCT No.: PCT/SE97/01873

§ 371 Date: May 10, 1999

§ 102(e) Date: May 10, 1999

(87) PCT Pub. No.: WO98/22771

PCT Pub. Date: May 28, 1998

(30) Foreign Application Priority Data

Nov. 19, 1996 (SE) ..... 9604220

(51) Int. Cl.[7] ..... F28F 3/08

(52) U.S. Cl. ..... 165/167; 165/166; 165/96; 165/135; 165/916

(58) Field of Search ..... 165/166, 81, 174, 165/135, 916, 96, 167

(56) References Cited

U.S. PATENT DOCUMENTS

| | | | | |
|---|---|---|---|---|
| 3,229,764 | | 1/1966 | Ware . | |
| 3,495,656 | | 2/1970 | Dickson . | |
| 3,542,124 | | 11/1970 | Manfredo et al. . | |
| 5,029,636 | * | 7/1991 | Kadle | 165/916 X |
| 5,036,911 | * | 8/1991 | So et al. | 165/916 X |
| 5,575,329 | * | 11/1996 | So et al. | 165/916 X |
| 5,676,203 | * | 10/1997 | Kajikawa et al. | 165/916 X |
| 5,915,469 | * | 6/1999 | Abramzon et al. | 165/135 X |
| 5,931,219 | * | 8/1999 | Kull et al. | 165/166 X |
| 5,954,126 | * | 9/1999 | Aombruster | 165/166 X |

FOREIGN PATENT DOCUMENTS

| | | |
|---|---|---|
| 245 491 | 8/1947 | (CH) . |
| 420 020 | 9/1981 | (SE) . |
| 1 299 235 | 4/1994 | (SU) . |

* cited by examiner

*Primary Examiner*—Christopher Atkinson
(74) *Attorney, Agent, or Firm*—Merchant & Gould P.C.

(57) ABSTRACT

Arrangement in a heat exchanger, for example a retarder oil cooler, constructed from plates with alternating cooling water and oil ducts between them. The plates surrounding the cooling water ducts are provided with converging inward bends in the form of nipples, which are intended to keep the said plates at a distance from one another. Between the plates surrounding the oil ducts there is a so-called turbulator, which on the one hand serves to increase the surface and on the other is designed to make the flow turbulent. The arrangement is characterized in that the oil ducts situated outermost in the cooler each comprise elements designed to reduce the flow through these compared to the flow in other oil ducts. An improved thermal equilibrium is thereby achieved in the outermost ducts, which gives a reduced risk of thermal fatigue, especially in the inward bends converging in the cooling water ducts in the form of nipples. The service life of the heat exchanger is thereby prolonged.

4 Claims, 5 Drawing Sheets

ARRANGEMENT FOR FLOW REDUCTION IN PLATE OIL COOLER

The present invention relates to an arrangement in a heat exchanger having alternating cooling water ducts and water ducts.

Conventional heat exchangers in the form of retarder oil coolers are usually constructed from plates with alternating cooling water and oil ducts between them. The cooling water, which remains at an essentially lower temperature than the oil to be cooled, flows in the outermost ducts. The said ducts adjoin the first oil ducts on the one side and the surroundings on the other. This means that relatively large temperature differences will occur between their two sides, which gives rise to thermal stresses. These stresses arise in particular at the commonly occurring, converging inward bends which are made on the plates surrounding the outermost cooling water ducts in order keep the said plates at a distance from one another. Owing to thermal fatigue the said inward bends may rupture and leakage occur, which can cause the heat exchanger to fail.

An object of the present invention is to produce an arrangement in a heat exchanger, for example a retarder oil cooler of the aforementioned type, by means of which the above-mentioned disadvantages are eliminated.

The arrangement according to the invention in a heat exchanger has several advantages. By means of this, a better thermal equilibrium is achieved in the outermost ducts, thereby reducing the risk of thermal fatigue. The service life of the heat exchanger is also thereby prolonged.

Figure 1:
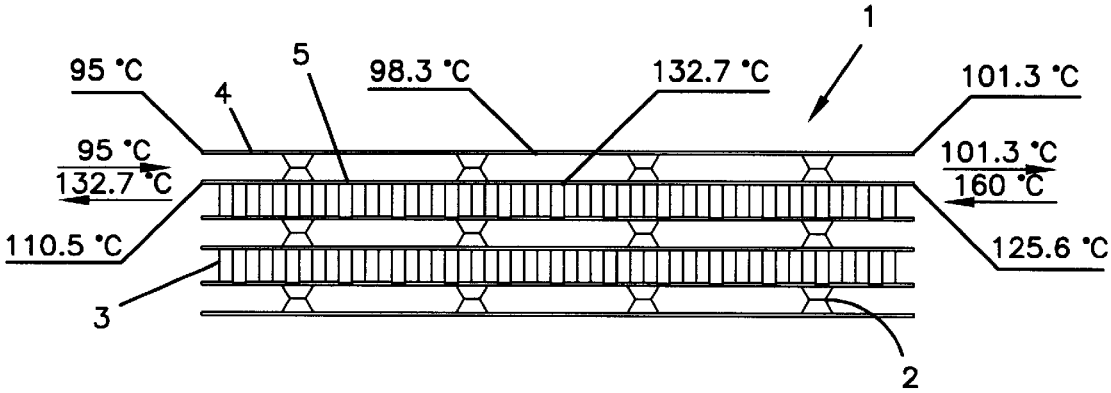
FIG. 1 PRIOR ART
Figure 2:
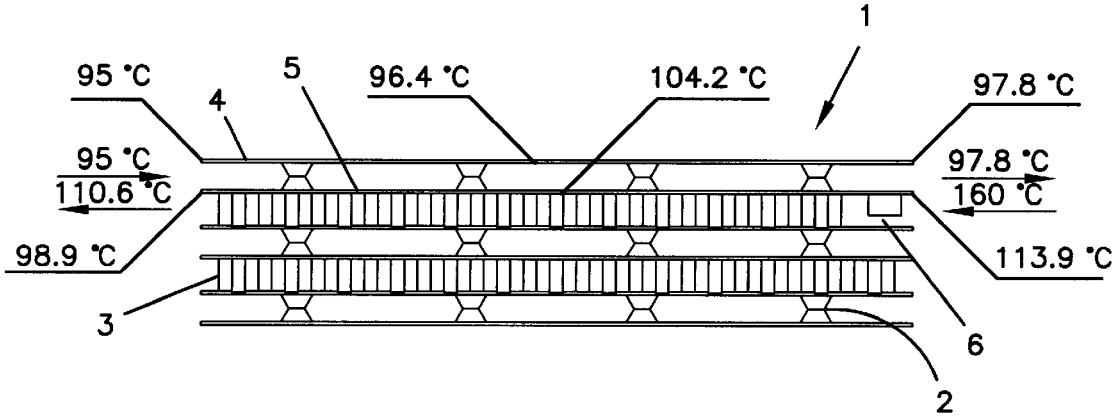
Figure 3:
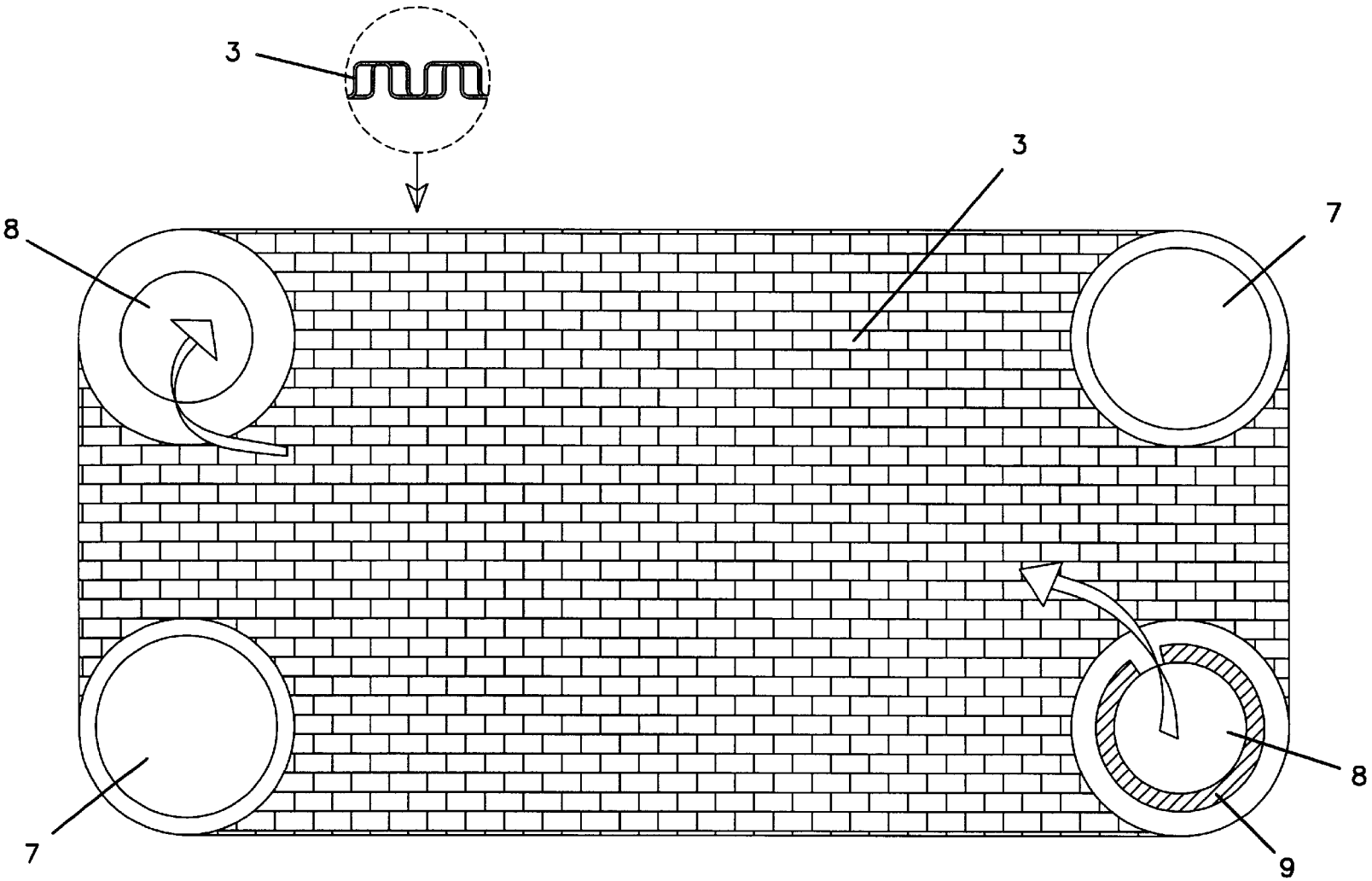
Figure 4:
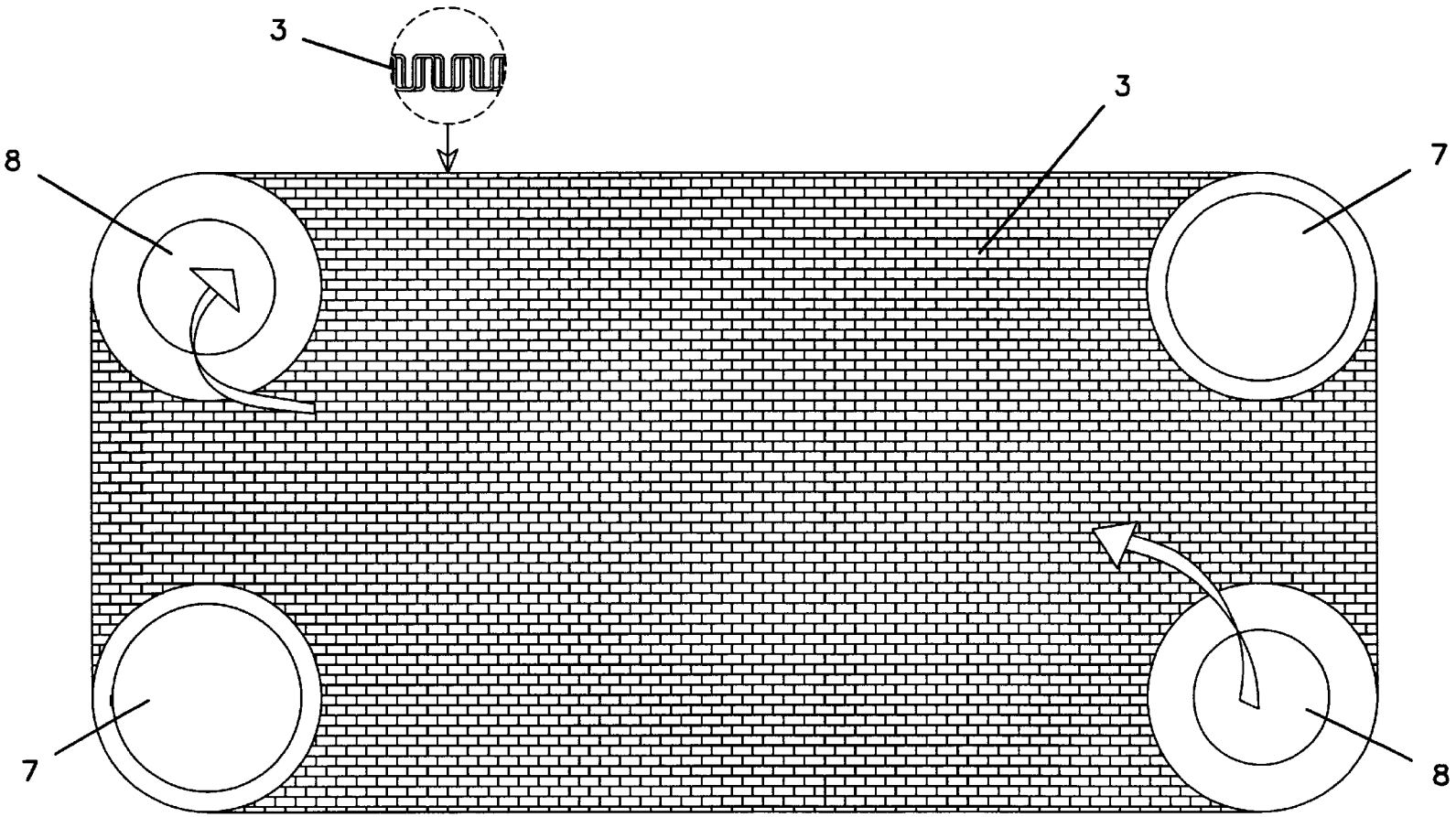
Figure 5:
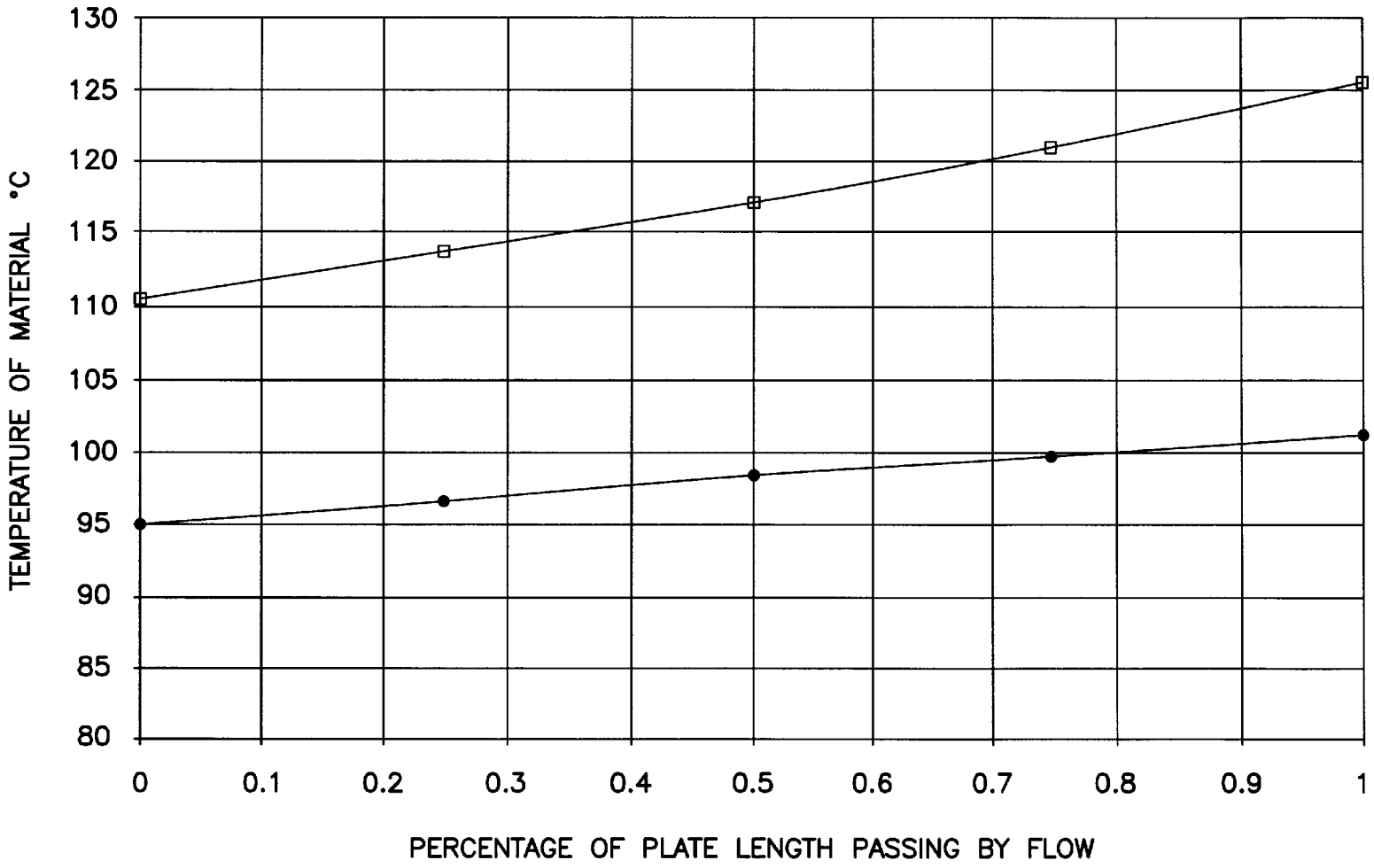
Figure 6:
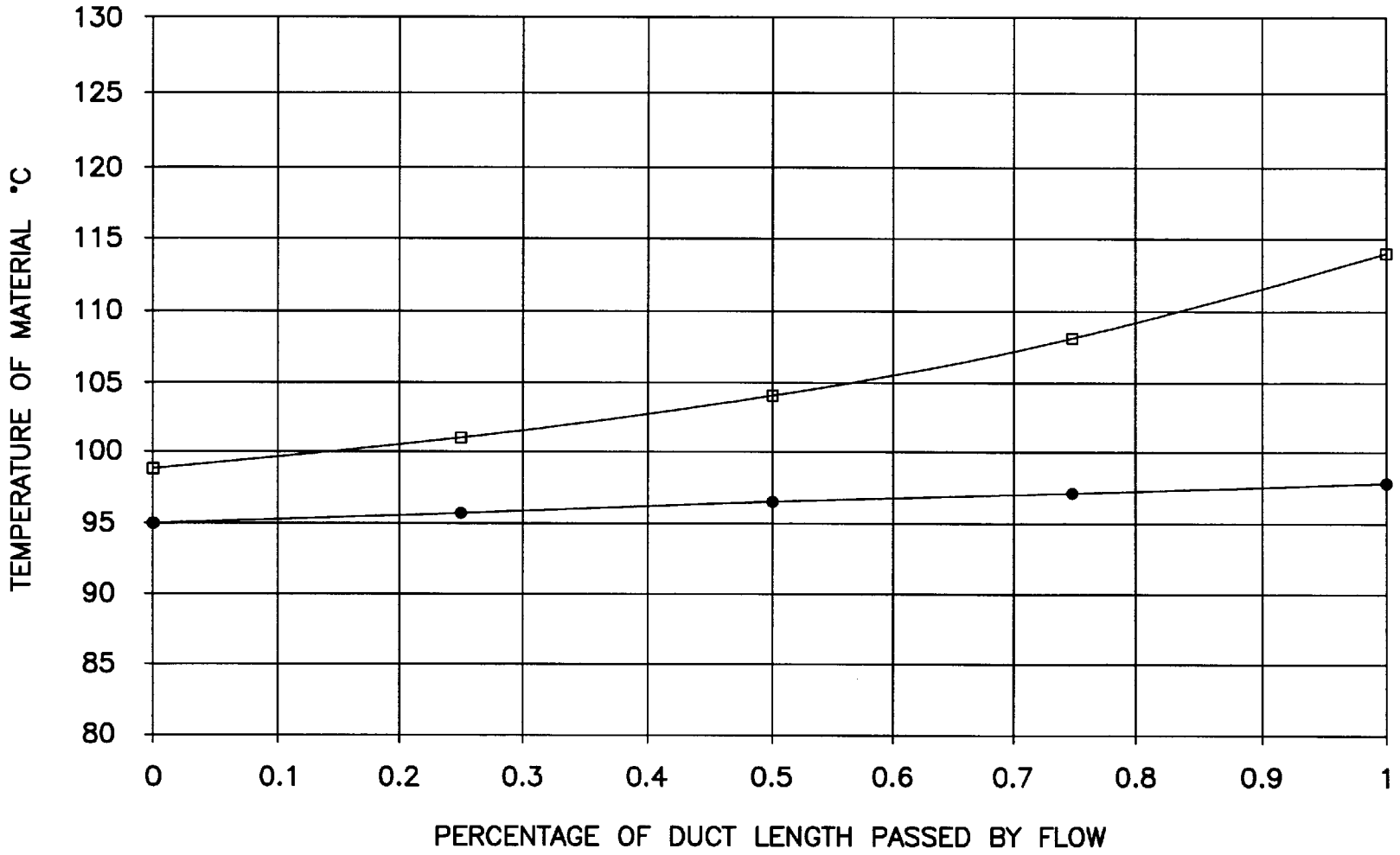

One embodiment of the present invention will explained in more detail below with the aid of examples and with reference to the drawings attached, in which:

FIG. 1 shows a partial section through a heat exchanger in the form of a retarder oil cooler according to the prior art, with examples of the inlet and outlet temperature of the media and the mean temperatures of the plates, and FIG. 2 shows a partial section through an embodiment of a heat exchanger according to the invention in the form of a retarder oil cooler, with examples of the inlet and outlet temperatures of the media and the mean temperature of the plates where the outer oil duct is provided with restriction according to an example of one embodiment of the present invention, and FIG. 3 is a sectional view from above through an outer oil duct, showing how a surface-increasing, turbulence-generating device is arranged therein and how an element designed to reduce the flow through the oil duct in the form of a slit ring is arranged at its inlet opening, and FIG. 4 is a sectional view from above through an outer oil duct showing how a surface-increasing, turbulence-generating device, designed to produce greater flow resistance than the elements in other oil ducts, is arranged therein, and FIG. 5 is a diagram showing the temperature conditions at outer primary and second plate with flow along the plates and unrestricted flows in all ducts, and FIG. 6 is a diagram showing the temperature conditions at outer primary and second plate with flow along the plates where the oil flow is restricted to 25% of the full flow in outer oil ducts.

The heat exchangers 1 shown in FIGS. 1 and 2, in this example in the form of retarder oil coolers, are intended to cool oil in a retarder brake system in a vehicle, the normal working temperature of the oil being approximately equal to the cooling water temperature. In systems of this type the temperature of the oil given in ° C. can rise quickly to around double the value. The oil is usually cooled by means of the vehicle's cooling water.

The temperatures quoted in the examples below are only approximate mean temperatures and are only given in order to illustrate the problem and as an example of a solution according to the invention.

The example in FIG. 1 shows a partial section through a commonly occurring retarder oil cooler 1, constructed from plates with alternating cooling water and oil ducts between them. The plates that enclose the cooling water ducts are provided with converging inward bends 2 in the form of nipples, which are intended to keep the said plates at a distance from one another. Between the plates that enclose the oil ducts there are so-called turbulators 3, which on the one hand serve to increase the surface and on the other are designed to make the flow turbulent, and which also keep the said plates at a distance from one another. In this example undulating turbulators 3 are shown.

The flow through the cooling water ducts is designed to be identical in all ducts. The same applies to the flow through the oil ducts. In this example oil arrives at the oil inlet side of the cooler at a temperature of approximately 160° C. In this example the cooling water which arrives at the cooler remains at approximately 95° C. On the water outlet side the cooling water remains at approximately 101° C., and therefore the primary plates 4 of the cooler, adjoining the surroundings at those of the outermost ducts, remain at a temperature of approximately 98° C. The oil flowing through the ducts situated immediately inside these remains at a temperature of approximately 133° C., and therefore the secondary plates 5 of the outermost cooling water ducts adjoining those of the outermost oil ducts will show a temperature of approximately 117° C. This relatively large temperature difference between the primary and secondary plates of the first cooling water ducts imposes great thermal stresses on these, especially where the primary and secondary plates, which enclose the first cooling water ducts, are provided with inward bends 2 converging in the cooling water duct in the form of nipples. Owing to thermal fatigue the said inward bends 2 may rupture and leakage occur which can cause the retarder oil cooler to fail.

FIG. 2 shows an embodiment of a retarder oil cooler according to the invention. This is also constructed in the same way as the retarder oil cooler according to FIG. 1.

The flow through the cooling water ducts is designed to be equal for all ducts. The same does not apply, however, to the flow through the oil ducts. In this example the flow in the outermost oil ducts is reduced by means of a flow-reducing element 6, by approximately 75% compared to other oil ducts. In this example, as in the previous example, oil arrives at the oil inlet side of the cooler at a temperature of approximately 160° C. In this example, again as in the previous one, the cooling water which reaches the cooler remains at approximately 95° C. On the water outlet side the cooling water remains at approximately 98° C., and therefore the primary plates 4 of the cooler, adjoining the surroundings at those of the outermost ducts, will remain at a temperature of approximately 96° C. The oil that flows through the outermost ducts will now remain at an outlet temperature of approximately 111° C., however, owing to the reduced flow, and therefore the secondary plates 5 of the outermost cooling water ducts, adjoining the outermost oil ducts, will show a temperature of approximately 104° C. This reduced temperature difference between the primary and secondary plates of the first cooling water ducts represents a significant reduction of the thermal stresses on these, especially at the inwards bends 2 converging in the cooling water ducts in the form of nipples. In the remaining ducts the flow is not reduced, and therefore the oil that flows through these outermost oil ducts remains at an outlet temperature of approximately 133° C., so that the plates enclosing the next outermost cooling water ducts will show a temperature of approximately 104° C. or 117° C. respectively. This moderate temperature difference between the two sides of the next outermost cooling water ducts also imposes low thermal stresses on these, especially at their nipples. The plates of the remaining cooling water ducts, adjoining the non-flow restricted oil ducts, will ultimately be thermally balanced and show temperatures of approximately 117° C.

FIG. 3 is a sectional view from above through an outer oil duct showing how a surface-increasing, turbulence-generating device 3 is arranged in the said duct and how, according to a preferred embodiment of the invention, an element 6 in the form of a slit ring 9, designed to reduce the flow through the oil duct, is arranged at its inlet opening. The form of the surface-increasing, turbulence-generating device is shown in more detail in a detached partial side view surrounded by a dashed circle.

The outermost primary plate at a first end of the stack of plates, which constitutes the cooler, is provided in one area of each of its ends with two circular openings 7, 8. These extend further down through the stack of plates and are bounded by a wall at the outermost primary plate at the other end of the stack of plates. The first of these openings 7 at the respective ends of the plate connects the inlet and outlet openings of the water ducts in that it is open to these and closed to the inlet and outlet openings of the oil ducts respectively. The second of these openings 8 at the respective ends of the plate correspondingly connects the inlet and outlet openings of the oil ducts in that it is open to these and closed to the inlet and outlet openings of the water ducts respectively. At the first end of the stack of plates the openings are provided with connection pieces for connecting oil and water lines respectively.

In this example the openings 7, 8 through the stack of plates are circular and the flow reduction in the outermost oil ducts is, as shown in FIG. 3, achieved in that a slit ring 9 is inserted into the inlet openings of the outermost oil ducts. The slit is preferably directed essentially towards the undulating shape of the turbulator. The arrows in the figure indicate the direction of the oil flow.

It is obvious that this flow reduction can be achieved in ways other than that here shown as an example, for example as shown in FIG. 4, by designing the surface-increasing and turbulence-generating device 3 in the outer oil ducts to produce a greater flow resistance than the device in other channels, it being possible to design the device, for example, as shown in FIG. 3. As will be seen from FIG. 4 and its detached partial side view surrounded by a dotted circle, the surface-increasing, turbulence-generating device 3 is in this example designed more tightly. In this figure, as in FIG. 3, the arrows indicate the direction of the oil flow.

The diagrams in FIG. 5 and FIG. 6 show the temperature conditions at outer primary and secondary plate with a flow along the plates and with the flow either unrestricted in all ducts, or where the oil flow is restricted to 25% of the full flow in the outer oil ducts.

In FIG. 5 the upper curve, marked by short double strokes, shows the temperature of the material in the secondary plate 5, which is situated between cooling water duct and oil duct respectively. The lower curve, marked with dots, shows the temperature of the material in the primary plate 4, which is situated between outer cooling water duct and the surroundings of the cooler. The mean temperature difference between the primary and secondary plates is approximately 19° C.

In FIG. 6 the upper curve marked by squares shows the temperature of the material in the secondary plate 5 and the lower curve marked by dots shows the temperature of the material in the primary plate 4. The mean temperature difference between the primary and secondary plates is in this case essentially lower and amounts to approximately 9° C.

What is claimed is:

1. Arrangement in a heat exchanger comprising a retarder oil cooler that is constructed from plates with alternating cooling water and oil ducts between the plates which are connected to one another in parallel and have inlet and outlet openings, wherein the oil ducts situated immediately inside one or more outermost cooling water ducts each comprise elements designed to reduce the flow through said oil ducts compared to the flow in other oil ducts, and the elements designed to reduce the flow comprise a slit ring that is inserted into the inlet opening of the oil duct, the inlet opening being provided as a circular opening extending through the oil duct, the slit ring being located around a periphery thereof.

2. Arrangement according to claim 1, wherein the flow in the oil ducts situated immediately inside the outermost cooling water ducts is reduced by 50–90% compared to the flow in other oil ducts.

3. Arrangement in a heat exchanger comprising a retarder oil cooler that is constructed from plates with alternating cooling water and oil ducts between the plates which are connected to one another in parallel and have inlet and outlet openings, wherein the oil ducts situated immediately inside one or more outermost cooling water ducts each comprise elements designed to reduce the flow through said oil ducts compared to the flow in other oil ducts, wherein the flow-reducing elements comprise surface-increasing and turbulence-generating devices situated in the oil ducts, wherein the devices in the oil ducts situated immediately inside the outermost cooling water ducts are designed to produce a greater flow resistance than the devices in other oil ducts.

4. Arrangement according to claim 3, wherein the flow in the oil ducts situated immediately inside the outermost cooling water ducts is reduced by 50–90% compared to the flow in other oil ducts.

* * * * *